US006004115A

United States Patent [19]

da Costa

[11] Patent Number: 6,004,115

[45] Date of Patent: Dec. 21, 1999

[54] HERMETIC COMPRESSOR FOR REFRIGERATION SYSTEMS

[75] Inventor: Caio Mario Franco Netto da Costa, Joinville, Brazil

[73] Assignee: Empresa Brasileira de Compressores S/A - Embraco, Joinville-SC, Brazil

[21] Appl. No.: 08/693,103

[22] PCT Filed: Dec. 1, 1995

[86] PCT No.: PCT/BR95/00060

§ 371 Date: Nov. 5, 1996

§ 102(e) Date: Nov. 5, 1996

[87] PCT Pub. No.: WO96/17170

PCT Pub. Date: Jun. 6, 1996

[30] Foreign Application Priority Data

Dec. 2, 1994 [BR] Brazil ..... 9404646

[51] Int. Cl.[6] ..... F04B 17/00

[52] U.S. Cl. ..... 417/413.2

[58] Field of Search ..... 417/413.2, 322

[56] References Cited

U.S. PATENT DOCUMENTS

| | | | |
|---|---|---|---|
| 3,194,162 | 7/1965 | Williams | 103/1 |
| 3,391,680 | 7/1968 | Benson | 123/139 |
| 3,418,980 | 12/1968 | Benson | 123/32 |
| 4,115,036 | 9/1978 | Paterson | 417/322 |
| 4,432,699 | 2/1984 | Beckman et al. | 417/63 |
| 4,449,893 | 5/1984 | Beckman et al. | 417/322 |
| 4,515,534 | 5/1985 | Lawless et al. | 417/322 |
| 4,752,788 | 6/1988 | Yasuhara et al. | 346/140 R |
| 4,842,493 | 6/1989 | Nilsson | 417/322 |

FOREIGN PATENT DOCUMENTS

| | | |
|---|---|---|
| 0 122 993 | 10/1984 | European Pat. Off. . |
| 2 238 883 | 6/1991 | United Kingdom . |
| 2 257 478 | 1/1993 | United Kingdom . |

*Primary Examiner*—Timothy S. Thorpe
*Assistant Examiner*—Ehud Gartenberg
*Attorney, Agent, or Firm*—Darby & Darby

[57] ABSTRACT

A hermetic compressor for refrigeration systems, having a plurality of pistons of piezoelectric material (20) arranged within a hermetic shell (10), according to at least one sequential alignment and occupying, when in a first energizing condition, all of the corresponding internal volume of the hermetic shell (10). Each of the pistons (20) contracts relative to the same first lateral wall (14) of the hermetic shell (10) when in the second energizing condition, so as to have one of its end faces (21) distanced from the shell first lateral wall (14) in order to define the respective volume of fluid being compressed, which volume progressively decreases from the first to the last piston (20). An energizing means imparts electrical signals to the pistons (20) in a selective manner to establish each of the first and second energizing conditions, so as to cause the displacement and progressive compression of the initial volume of fluid admitted into the hermetic shell (10), from the inlet (11) to the outlet (12) of the hermetic shell (10).

2 Claims, 2 Drawing Sheets

HERMETIC COMPRESSOR FOR REFRIGERATION SYSTEMS

FIELD OF THE INVENTION

The present invention refers to a hermetic compressor to be used in refrigeration systems, such as refrigerators, freezers, air conditioners and others which require high pressure pumping.

BACKGROUND OF THE INVENTION

Those compressors commonly used in refrigeration systems of refrigerators in general and in air conditioners should meet some requirements such as reliability, low noise and vibration levels, high energetic yield, small dimensions and low cost. Conventional models on the market only partially meet these requirements.

The pumping of the refrigerant fluid in conventional compressors (of the reciprocating, rotary or centrifugal types, for example) is achieved by the relative movement between some components of these compressors, requiring constant and efficient lubrication for reducing friction and wear between the contacting parts of these components. Although the presence of oil reduces friction and wear in the compressors, it does have some drawbacks, such as the possibility of infiltration in the refrigeration system, the lubricant oil mixing with the refrigerant liquid. The circulation of oil in the refrigeration cycle reduces the efficiency of the system, increasing its energetic consumption. So that the infiltration of oil in the refrigeration system does not contaminate the refrigerant fluid, there should be compatibility between the fluids, which restricts the range of choices of said fluids.

Another drawback of the conventional compressors refers to their energetic consumption to operate the relative movement cited above. A large percentage of energy of said compressors is spent overcoming mechanical friction and inertia and not in pumping the refrigerant gas, thereby limiting the compressor yield and compromising its efficiency. Moreover, the parts with relative movement are continually submitted to mechanical fatigue and wear, requiring more resistant parts, which are consequently more expensive and increase the compressor costs. It has also been observed that the more movable parts a compressor has, higher will be its energetic consumption and costs.

To overcome the above cited problems, solutions have been developed for the pumping system, by pressurizing the refrigerant fluid by thermal variation, stimulating said refrigerant fluid or by the application of sound waves (U.S. Pat. No. 5,020,977, U.S. Pat. No. 5,167,124 and U.S. Pat. No. 5,174,130).

Although other solutions for pumping are known in the state of the art, such as by crystal piezoelectric action (U.S. Pat. No. 5,271,724), such solutions are not applicable to refrigeration systems in general.

DISCLOSURE OF THE INVENTION

Thus, the generic object of the present invention is to provide a compressor for refrigeration systems, especially refrigerators and air conditioners, which uses, at least in its system for pumping the refrigerant fluid to the refrigeration circuit, a smaller quantity of mechanical components presenting relative movement, in order to decrease vibrations and noise.

Another object of the present invention is to provide a compressor such as that mentioned above and which presents a high operational yield with low energetic consumption.

Another object of the present invention is to provide a compressor with the above cited advantages, having small dimensions and reduced costs.

These and other objectives are reached by means of a hermetic compressor for a refrigeration system of the type comprising a hermetic shell presenting an end gas inlet and an opposite end gas outlet; a plurality of pistons arranged inside the hermetic shell according to at least a sequential alignment and constructed of piezoelectric material, said pistons occupying, when in a first energizing condition, all of the corresponding internal volume of the hermetic shell in the assembly region of the pistons, each piston contracting longitudinally, from a same first lateral wall of the hermetic shell to a suction condition, when in a second energizing condition, so as to have one of its end faces distanced from the adjacent inner face of said first lateral wall of the hermetic shell defining, inside the latter, a respective volume of gas, which progressively decreases from the first to the last piston and which will be compressed in a compression cycle of an initial mass of gas admitted through the end gas inlet; energizing means imparting to the pistons, on a selective, electric and momentaneous manner, each one of the first and second energizing conditions, so as to cause the displacement and the progressive compression of said initial mass of gas from the end gas inlet to the end gas outlet.

The hermetic compressor for refrigeration systems such as that described above presents advantages over those conventional compressors, such as fewer components with relative movement, reliability and smaller dimensions.

BRIEF DESCRIPTION OF THE DRAWINGS

The invention will be described below, based on the attached drawings, in which.

BEST MODE FOR CARRYING OUT THE INVENTION

Figure 1A:
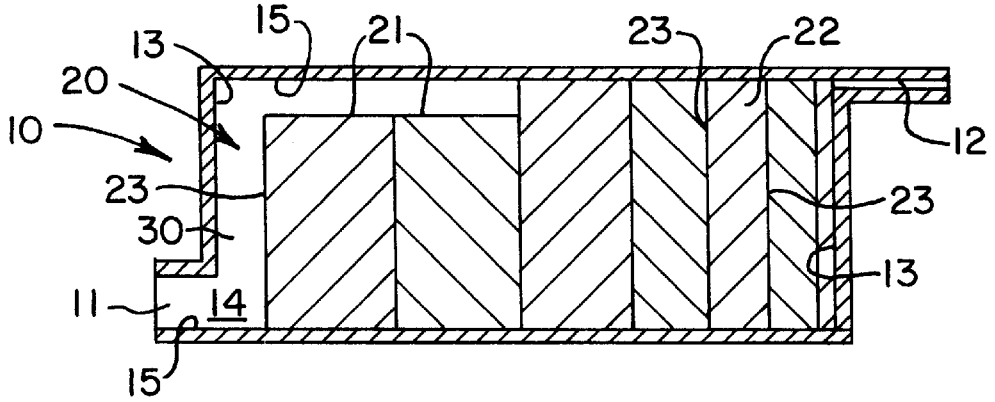
FIGS. 1*a* to 1*f* represent, schematically and in a cross sectional view, a hermetic compressor for a refrigeration system provided with the pumping assembly of the present invention in the different stages of a compression cycle.
Figure 1B:
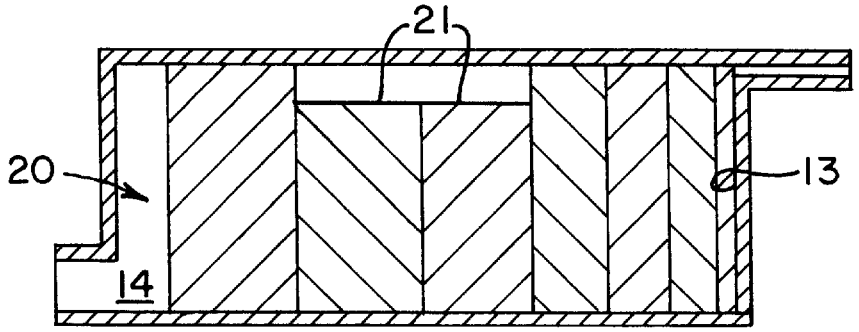
Figure 1C:
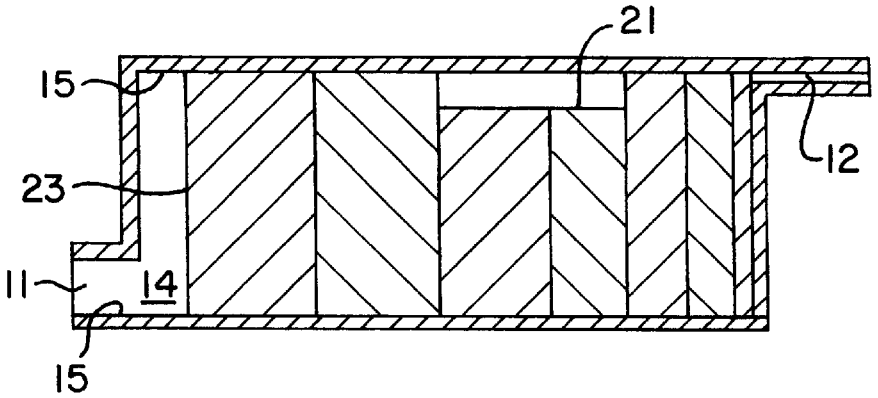
Figure 1D:
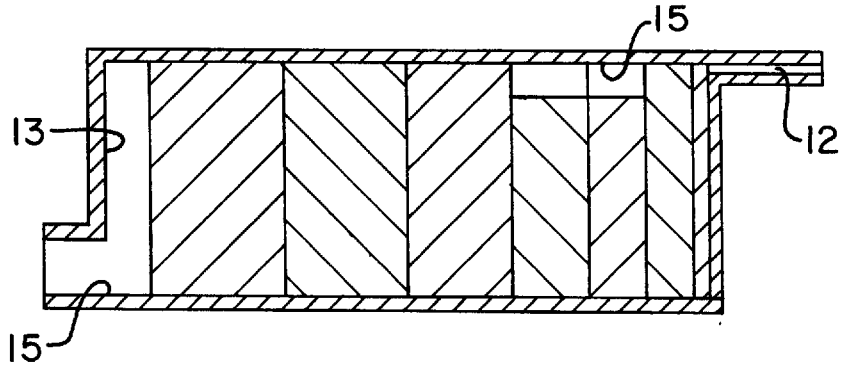
Figure 1E:
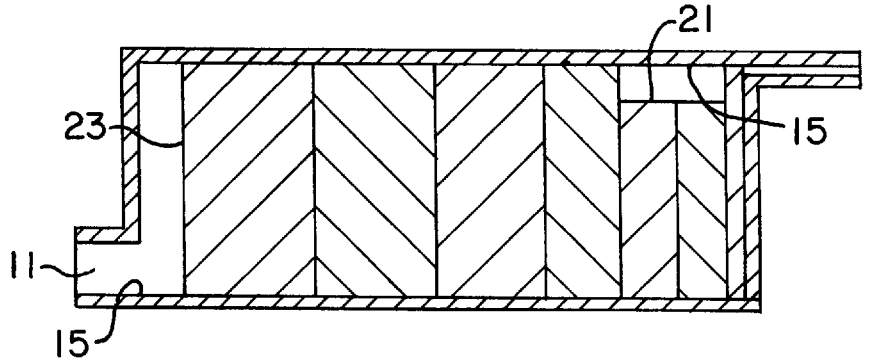
Figure 1F:
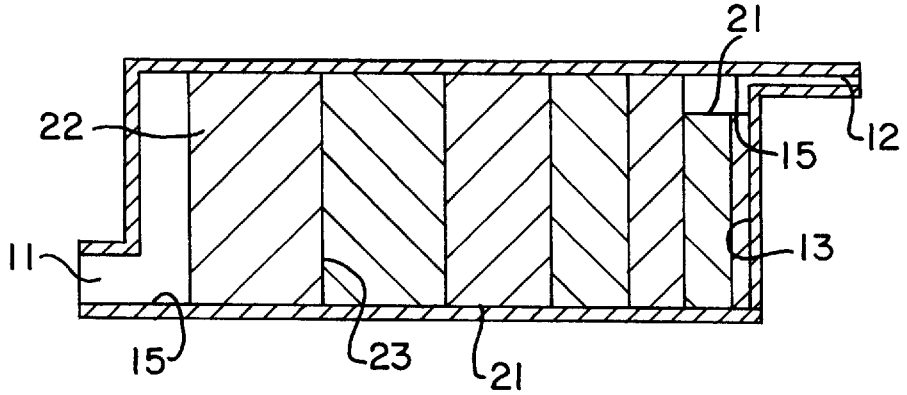

According to the illustrated figures, the compressor of the present invention comprises a hermetic shell 10 generally parallelepipedic and elongated, presenting an end gas inlet 11, connected to the low pressure side of the refrigeration system, and an opposite end outlet 12 for compressed gas, connected to the high pressure side of the refrigeration system. The hermetic shell 10 presents a pair of opposite end walls 13 and first and second pair of opposite lateral walls 14, 15, the second pair of opposite lateral walls 15 generally defining the upper and lower walls of the hermetic shell 10.

The hermetic shell 10 is dimensioned so as to house internally a plurality of pistons 20, also generally parallelepipedic and laterally adjacent to each other, preferably according to a longitudinal alignment, each piston 20 being defined by a block of piezoelectric material, contracting when submitted to a determined electric charge, such as a polarized electric charge or even an electric discharge. Each said piston 20 wholly reproduces the internal volume of the corresponding portion of hermetic shell 10 where it is assembled, when in an expansion condition defined in function of a first energizing condition to be described later.

Although not illustrated, the pistons 20 may be arranged laterally to each other according to more than one longitudinal alignment or to lateral alignments.

The pistons 20 illustrated present a pair of opposite end faces 21, generally defining respective upper and lower faces, which stay in sealing contact with the adjacent inner face of the first pair of opposite lateral walls 14 of the hermetic shell 10 when said pistons 20 are submitted to a determined energizing condition, such as the first energizing condition defined by the selective and momentaneous application of a polarized electrical charge, for example a charge of positive polarity.

When submitted to a second energizing condition, in the form of a polarized electric charge of negative polarity, each piston 20 is conducted to a contracting position defined by the distancing of one of its opposite end faces 21 from the inner face of the adjacent second lateral wall 15 of the hermetic shell 10.

Although in the preferred construction being described the energizing conditions are reached by the application of a polarized electrical charge, the present invention allows for the possibility of said energizing conditions to be also obtained as, for example, by the de-energization of the pistons, defining the first energizing condition, or even by the application of electric discharge to said pistons for obtaining said energizing conditions. In the preferred solution, each piston 20, which not the first or the last of the sequence, is maintained in the second energizing condition during the change of the energizing condition of the piston 20 immediately preceding, from the second to the first energizing condition, and of the piston 20 immediately following, from the first to the second energizing condition.

Each piston 20 further presents a first pair of opposite lateral faces 22, in constant sealing contact with the adjacent inner face of the second pair of opposite lateral walls 15 of said hermetic shell 10 and a second pair of opposite lateral walls 23, generally defining a front face and a rear face of each said piston 20, which are respectively in sealing contact with pistons 20 immediately adjacent in the sequential alignment of pistons 20. A lateral (front) face 23 of the second pair of lateral faces of the first piston 20 and an opposite lateral (rear) face 23 of the last piston 20 of the sequence are disposed facing the inner face of the adjacent end wall 13 of the hermetic shell 10.

In another constructive option, when the pistons 20 are arranged in a sequential alignment not directly longitudinal, the pairs of first and second lateral faces of each piston should maintain a sealing contact with one of the parts defined by the lateral face of the adjacent piston, by the inner face of one of the second opposite lateral walls and by the inner face of one of the end walls of the hermetic shell 10.

In the preferred illustrated construction, the pistons 20 present identical dimensions of width and longitudinal length, the thickness varying in function of the pumping effect which they should produce when sequentially energized in the pumping operation.

Since pistons 20 present a progressively decreasing transversal section, from the first piston to the last piston of the longitudinal alignment, the contraction of each piston of said sequence originates a new volume of gas, which is reduced relatively to that volume previously originated, which consequently increases the pressure of the gas contained in said volumes.

For compressing the gas admitted into the compressor being described, the gas volumetric reduction is obtained by a proportional and sequential variation in the thickness of pistons 20, in order to reduce said thickness from the first piston 20 of the sequential alignment, arranged adjacent to the end gas inlet 11 of the hermetic shell 10 up to the last piston 20 of said alignment, arranged adjacent to the opposite end outlet 12 of compressed gas of said hermetic shell 10. The thickness reduction is calculated upon the progression of compression to be obtained with the gas admitted into the hermetic shell 10, before this gas is discharged on the high pressure side of the refrigeration system.

In the preferred illustrated construction, the front lateral face 23 of the first piston 20 is distanced from the inner face of the adjacent end wall 13 of the hermetic shell, originating a gas inlet chamber 30 under low pressure within said hermetic shell 10. In this construction, the gas inlet chamber 30 remains in a continuous and constant contact with the low pressure side of the refrigeration system, while the end outlet 12 of compressed gas is closed by the last piston 20 arranged adjacent to said outlet. The selective discharge of compressed gas from the end gas outlet 12 takes place when the last piston 20 is submitted to the second energizing condition. In this construction, said last piston 20 acts as a discharge valve and the first piston 20 acts as a gas inlet valve.

The mass of gas which reaches the end gas inlet 11 is admitted into the region of pistons 20 by contraction of the first piston 20 of the sequence, said gas mass being progressively dislocated by means of the volumes of gas formed by the successive contraction of pistons 20 and compressed between the second and the next to penultimate piston 20.

In this construction, the compressed mass of gas discharged at the end gas outlet 12 will present a compression rate defined by the volumetric difference between the volume of gas of one of the next to penultimate and the penultimate pistons 20 and the volume of the initial mass of gas.

In another possible construction, the end gas inlet 11 and/or the end gas outlet 12 are selectively closed by the respective gas inlet valve and gas discharge valve of suitable construction. When a discharge valve is provided, the compression rate of the initial mass of gas is defined by the volumetric difference between the volume of gas of the last piston 20 and the volume of the initial mass of gas, the latter being the volume defined by the volume resulting from the contraction of the first piston 20, when the compressor is provided with an inlet valve and the volume resulting from the contraction of the second piston 20, when the first piston 20 defines the inlet valve.

For the compression of each initial mass of gas, the energization of pistons 20 should not allow the simultaneous fluid communication between the end gas inlet and the end gas outlet of hermetic shell 10. During the admittance of gas into said hermetic shell 10, when at least the first piston 20 is being submitted to the second energizing condition for the formation of the corresponding volume of gas, at least the last piston 20 should be submitted to the first energizing condition, blocking the direct and simultaneous communication between the end gas inlet 11 and the end gas outlet 12. In a similar manner, in the compressed gas discharge condition, at least one piston 20 placed prior to the gas mass compressed for discharge should be submitted to the first energizing condition.

Although in the preferred solution in each cycle of compression, while one piston 20 of the sequence is maintained submitted to the second energizing condition, the piston 20 immediately preceding is found in the first energizing condition and piston 20 immediately following is submitted to the change from the first to the second energizing condition, other options are possible and defined upon the frequency of simultaneous compression cycles desired for the operation of the compressor. The maximum number of simultaneous cycles will be equal to half of the number of pistons assembled inside the hermetic shell 10, but in this solution the first energizing condition of a piston 20 will correspond to the second energizing condition of the immediately adjacent pistons 20.

The compressor of the present invention also presents a piston energizing means, not shown, which imparts in a selective, electrical and momentaneous manner to the pistons 20 of the sequence, each one of the first and second energizing conditions, so as to cause the displacement and progressive compression of the initial mass of gas admitted into the hermetic shell from its end gas inlet 11 to the end gas outlet 12.

When the compressor operation is requested, the piston energizing means submits the first piston 20 to a polarized electric charge, causing the momentaneous longitudinal contraction thereof and the consequent distancing of one of its end faces, preferably its upper face 21, from the inner face of the adjacent wall portion of the second pair of lateral walls 15 of the hermetic shell 10.

In another solution, not illustrated, the compression results from the sequential volumetric reduction obtained by the difference in piston contraction, which is a function of the difference of energization to which each of said piston in the sequence is submitted. This difference of energization may be obtained by a difference in the energizing time or in the intensity of energization. In the preferred illustrated solution, the energizing condition is uniform and instantaneous for all of the pistons 20.

The hermetic condition of each gas volume, formed when each piston 20 is submitted to the second energizing condition, is obtained by the constant sealing contact between the first and second opposite lateral faces of each piston 20, one of the parts being defined by the adjacent faces of an adjacent piston and by the inner face of the adjacent portion of one of the first and second opposite lateral walls of the hermetic shell 10, and by the sealing contact, in the maximum expanding condition of each piston, between the opposite end faces of said pistons and the inner face of the adjacent end wall portion of the hermetic shell 10.

Although the preferred illustrated construction presents pistons of piezoelectric material, arranged according to only one sequential alignment in an elongated shell, other arrangements are possible, such as pistons of a transversal section in continuous reduction, varying according to a transversal extension relative to the longitudinal extension of the hermetic shell from the second piston in the sequence. Other constructions having portions of the shell in alignment are possible within the concept presented or even having a shell construction which internally defines at least part of the volumetric variation of each gas chamber formed. The compression may still be achieved by the relative distance between the upper face of each piston of the sequence and the inner face of the adjacent lateral wall portion of the hermetic shell, from a same first lateral wall of the latter and the lower face of each piston in relation to the inner face of the adjacent portion of another first lateral wall of the hermetic shell 10.

I claim:

1. A hermetic compressor for gases, comprising:

hermetic shell having an inlet for the gas and an outlet;

at least three pistons arranged within the hermetic shell in a sequential alignment between said inlet and outlet, each piston being constructed of a block of piezoelectric material, said pistons occupying, when in a first energizing condition, all of the corresponding internal volume of the hermetic shell in the region of the hermetic shell corresponding to each of the pistons, and each piston when in a second energizing condition contracting from a first lateral wall of the hermetic shell, to a suction condition to have one of its end faces distanced from the adjacent inner face of said first lateral wall and defining a respective volume for the gas, the volume defined by each piston progressively decreasing from the first to the last piston to compress the gas in a compression cycle of an initial volume of gas admitted into said inlet;

energizing means selectively imparting to said pistons electrical signals to produce said first and second energizing conditions to cause the displacement and progressive compression of the initial volume of gas from said inlet to said outlet.

2. Compressor, according to claim 1, wherein the progressive decrease in the volume of gas of each piston is produced by a sequential and progressive reduction in the cross-sectional area of a first opposite lateral wall of each said piston, said cross-sectional area reduction of each piston being matched by a sequential and corresponding step reduction in a distance between lateral walls which are perpendicular to said first lateral wall.

* * * * *